US010151108B2

(12) United States Patent
Hildebrand

(10) Patent No.: US 10,151,108 B2
(45) Date of Patent: Dec. 11, 2018

(54) SYSTEM, APPARATUS AND METHODS FOR PRECAST ARCHITECTURAL PANEL CONNECTIONS

(71) Applicant: Willis Construction Company, San Juan Bautista, CA (US)

(72) Inventor: Mark Hildebrand, San Juan Bautista, CA (US)

( * ) Notice: Subject to any disclaimer, the term of this patent is extended or adjusted under 35 U.S.C. 154(b) by 0 days.

(21) Appl. No.: 15/837,663

(22) Filed: Dec. 11, 2017

(65) Prior Publication Data

US 2018/0112401 A1 Apr. 26, 2018

Related U.S. Application Data

(62) Division of application No. 15/143,554, filed on Apr. 30, 2016, now Pat. No. 9,840,842.

(60) Provisional application No. 62/156,654, filed on May 4, 2015.

(51) Int. Cl.

| | |
|---|---|
| ***E04B 2/94*** | (2006.01) |
| ***E04H 9/02*** | (2006.01) |
| *E04B 1/38* | (2006.01) |

(52) U.S. Cl.

CPC ..... *E04B 2/94* (2013.01); *E04H 9/02* (2013.01); *E04B 2001/405* (2013.01)

(58) Field of Classification Search

CPC ..... E04B 2/94; E04B 2001/405; E04H 9/02
See application file for complete search history.

(56) References Cited

U.S. PATENT DOCUMENTS

| | | | | |
|---|---|---|---|---|
| 1,572,574 | A | 2/1926 | Strongborg | |
| 2,032,840 | A | 3/1936 | Flowers | |
| 3,160,233 | A | 12/1964 | Norman et al. | |
| 3,368,377 | A | 2/1968 | Hirayama et al. | |
| 3,493,082 | A * | 2/1970 | Bell | B64C 25/001 188/377 |
| 3,730,463 | A | 5/1973 | Richard | |
| 4,166,344 | A | 4/1979 | Ikonomou | |
| 4,321,989 | A | 3/1982 | Meinzer | |
| 4,831,805 | A * | 5/1989 | Noborisaka | E04B 1/043 52/235 |
| 5,065,874 | A * | 11/1991 | Fong | B61G 9/20 213/31 |
| 5,134,828 | A * | 8/1992 | Baur | E04B 1/043 52/699 |
| 5,271,197 | A | 12/1993 | Uno et al. | |

(Continued)

FOREIGN PATENT DOCUMENTS

| | | | | |
|---|---|---|---|---|
| CA | 2883418 | A1 * | 3/2014 | E04G 21/3247 |
| EP | 1156169 | A1 * | 11/2001 | E04B 2/94 |

(Continued)

*Primary Examiner* — Jeanette E Chapman

(74) *Attorney, Agent, or Firm* — J. Curtis Edmondson; Law Offices of J. Curtis Edmondson

(57) ABSTRACT

Architectural precast concrete construction relies on mechanical connectors at discrete location that may be damaged in a blast or seismic event, posing specific design problems to the engineer. These problems can be overcome with proper detailing. The performance of precast concrete cladding wall panel connection details may be enhanced by incorporating a specific connection hardware, herein described, that deforms elastically or inelastically to accommodate relative displacements due to building motion and/or energy associated with blast pressures.

11 Claims, 10 Drawing Sheets

(56) References Cited

U.S. PATENT DOCUMENTS

| | | | | |
|---|---|---|---|---|
| 5,328,211 | A * | 7/1994 | Lewis | F16L 13/147 285/23 |
| 6,007,269 | A | 12/1999 | Marinelli | |
| 6,168,346 | B1 | 1/2001 | Ernsberger | |
| 6,220,576 | B1 | 4/2001 | Chan | |
| 6,662,506 | B2 | 12/2003 | Fischer | |
| 7,478,796 | B2 | 1/2009 | Burkett | |
| 9,340,969 | B1 * | 5/2016 | Shaw | E01C 11/06 |
| 2008/0092459 | A1 * | 4/2008 | Hilmy | E04H 9/02 52/167.1 |
| 2009/0044480 | A1 | 2/2009 | Bonds | |
| 2011/0121152 | A1 * | 5/2011 | Ghatikar | E04B 9/18 248/309.1 |
| 2011/0146181 | A1 * | 6/2011 | Traulsen | E04B 2/94 52/474 |
| 2011/0277865 | A1 * | 11/2011 | Kramer, Jr. | B29C 53/305 138/122 |
| 2012/0055102 | A1 * | 3/2012 | Fradera Pellicer | E04B 1/4121 52/167.1 |
| 2012/0110788 | A1 * | 5/2012 | Chen | E04B 2/7405 16/94 R |

FOREIGN PATENT DOCUMENTS

| | | | | |
|---|---|---|---|---|
| WO | WO-2006019100 | A1 * | 2/2006 | D21B 1/066 |
| WO | WO-2017056265 | A1 * | 4/2017 | E04H 9/02 |

* cited by examiner

SYSTEM, APPARATUS AND METHODS FOR PRECAST ARCHITECTURAL PANEL CONNECTIONS

CROSS-REFERENCE TO RELATED APPLICATIONS

This application is a divisional of U.S. patent application Ser. No. 15/143,554, filed on Apr. 30, 2016, which claims the benefit of U.S. Provisional Patent Application No. 62/156,654, filed on May 4, 2015, both of which are incorporated by reference in their entireties herein.

BACKGROUND

Architectural precast panels are widely used in the commercial construction industry. They provide a low cost and efficient exterior paneling system for multistory buildings. Architectural panels also have the schedule advantage of being fabricated off-site and then transported to the building site when needed. Architectural precast panels are easy to install and are relatively easy to repair when compared to other forms of exterior panel construction.

Architectural precast construction relies on mechanical connectors at discrete locations that are subjected to very large forces in a blast event, posing specific design problems to the engineer. These problems can be overcome with proper detailing.

Architectural panels typically have a row of connections at the top of the panel and a second row of connections at the bottom of the panel. Some architectural panels also have a row of connections along the sides of the panels. These connections are then attached to the structure through mounting brackets that are welded to the structural steel frame or embedded in the structural concrete.

For aesthetic reasons, it is usually desired to have the panels as close together as possible. The gaps between the panels are typically filled with an elastomeric sealant. Large gaps between panels are visually unattractive and the sealant must be maintained more frequently than the architectural panels.

Multistory buildings are flexible structures that are designed to accommodate external forces. Common forces include horizontal and vertical ground forces (e.g. earthquakes) or horizontal forces (e.g. wind pressure and blast pressure).

Although the internal steel structure is flexible, the exterior architectural panels are relatively rigid in comparison. When an external force causes the building to flex the panel connections must accommodate relative movements between the flexing structure and the rigid panels. The capacity of a panel to deform significantly and absorb energy is dependent on the ability of its connections to maintain integrity throughout the blast response. If connections become unstable at large displacements, failure can occur. The overall resistance of the panel assembly will be reduced, thereby increasing deflections or otherwise impairing panel performance.

It is also important that connections for blast loaded members have sufficient rotational capacity. A connection may have sufficient strength to resist the applied load; however, when significant deformation of the member occurs the rotational capacity may be reduced due to buckling of stiffeners, flanges, or changes in nominal connection geometry, etc.

Both bolted and welded connections can perform well in a blast environment, if they can develop strength at least equal to that of the connected elements or at least to that of the weakest of the connected elements.

For a panel to absorb blast energy and provide ductility while being structurally efficient, it must develop its full plastic flexural capacity which assumes the development of a collapse mechanism. The failure mode should be yielding of the steel and not splitting, spilling or pulling out of the concrete. This requires that connections are designed for at least 20% in excess of the member's bending capacity. Also, the shear capacity of the connections should be at least 20% greater than the member's shear capacity, and steel-to-steel connections should be designed such that the weld is never the weak link in the connection. Coordination with interior finishes needs to be considered due to the larger connection hardware required to resist the increased forces generated from the blast energy.

Where possible, connection details should provide for redundant load paths, since connections designed for blasts may be stressed to near their ultimate capacity. The possibility of single connection failures must be considered, as well. Consideration should be given to the number of components in the load path and the consequences of a failure of any one of them. The key concept in the development of these details is to trace the load or reaction through the connection. This is much more critical in blast design than in conventionally loaded structures. Connections to the structure should have as direct a load transmission path as practical, using as few connecting pieces as possible.

Rebound forces or load reversal can be quite high. These forces are a function of the mass and stiffness of the member as well as the ratio of blast load to peak resistance. A connection that provides adequate support during a positive phase load could allow a member to become dislodged during rebound. Therefore, connections should be checked for rebound loads. It is conservative to use the same load in rebound as for the inward pressure. More accurate values may be obtained through dynamic analysis and military handbooks.

The protection of multistory buildings to damage from earthquakes is described in the prior art. U.S. Pat. No. 3,638,377 issued on Dec. 3, 1969 to Caspe, describes an earthquake resistant multi-story structure that isolates the structure from the relative ground motions. U.S. Pat. No. 3,730,463 issued on Apr. 20, 1971 to Richard, describes a shock mounting apparatus to isolate the building footings. U.S. Pat. No. 4,166,344 issued on Mar. 31, 1977 to Ikonomen describes a system that allows the relative motion of a building structure relative to the ground using frangible links.

Architectural precast concrete can also be designed to mitigate the air pressure effects of a bomb blast. Rigid facades, such as precast concrete, provide needed strength to the building through in-plane shear strength and arching action. However, these potential sources of strength are not usually taken into consideration in conventional design as design requirements do not need those strength measures. Panels are designed for dynamic blast loading rather than the static loading that is more typical. Precast walls, being relatively thin flexural elements, should be designed for a ductile response. There are design tradeoffs between panel stiffness and the load on panel connections. For a surface blast, the most directly affected building elements are the facade and structural members on the lower four stories. Although the walls can be designed to protect the occupants, a very large vehicle bomb at small standoffs will likely breach any reasonably sized wall at the lower levels. There is also a decrease in pressure with height due to the increase in distance and angle of incidence of the air blast. Chunks of concrete dislodged by blast forces move at high speeds and are capable of causing injuries.

Therefore, what is desired is an improved system for connecting pre-cast architectural panels to the structure of the building to accommodate structural movements during earthquakes or high forces due to air pressure events.

SUMMARY

Precast concrete cladding wall panel connection details may be strengthened compared to conventional connections by incorporating a significant increase in connection hardware. The present inventive subject matter describes the connection details that improve the performance of architectural precast concrete cladding systems subjected to seismic and blast events.

In its broadest form, the inventive subject matter provides an embodiment describing a system for protecting the interiors of a building from earthquakes and explosive blasts. The system includes precast architectural panel connectors. The precast architectural panel connector is comprised of a precast panel mounted on to a building structure; a structural element, which is connected to the precast panel via a threaded rod and a bracket; a crushing tube placed on the threaded rod, which is positioned against the bracket by using adjusting nuts; and, a coil spring placed on the threaded rod between the nuts and the crushing tube.

An embodiment of the present inventive subject matter describes an impact absorbing apparatus for a precast architectural panel connector comprising a crushing tube, which includes a hollow tube-like structure with a rectangular cross section. A first face of the rectangular tube-like structure can include a central aperture and the second face can be flat, also having a central aperture. Further, the first face can be parallel to the second face of the rectangular tube-like structure. The central aperture is adapted to receive a threaded rod which, upon an impact, the first face of the crushing tube is resiliently deformed thus absorbing the impact, and the second face remains intact.

A further embodiment of the present inventive subject matter describes an impact absorbing apparatus comprising of a coil spring that is positioned on the threaded rod between the adjusting nut and the crushing tube or the structural bracket. The spring absorbs impact energy by elastic compression and returns to its original shape after impact.

A further embodiment of the inventive subject matter describes a method for installing an architectural panel connector comprising the steps of mounting a precast panel on to a building structure; connecting the precast panels to the structural elements via a threaded rod and a bracket; placing crushing tubes on both sides of the bracket; adjusting the position of the crushing tubes against the brackets by using the adjusting nuts; and, placing a coil spring on the threaded rod between the adjusting nuts and the crushing tube.

These and other embodiments are described in more detail in the following detailed descriptions and the figures. The foregoing is not intended to be an exhaustive list of embodiments and features of the present inventive subject matter. Persons skilled in the art are capable of appreciating other embodiments and features from the following detailed description in conjunction with the drawings.

OVERVIEW OF THE SELECTED REFERENCE CHARACTERS

Figure 1:
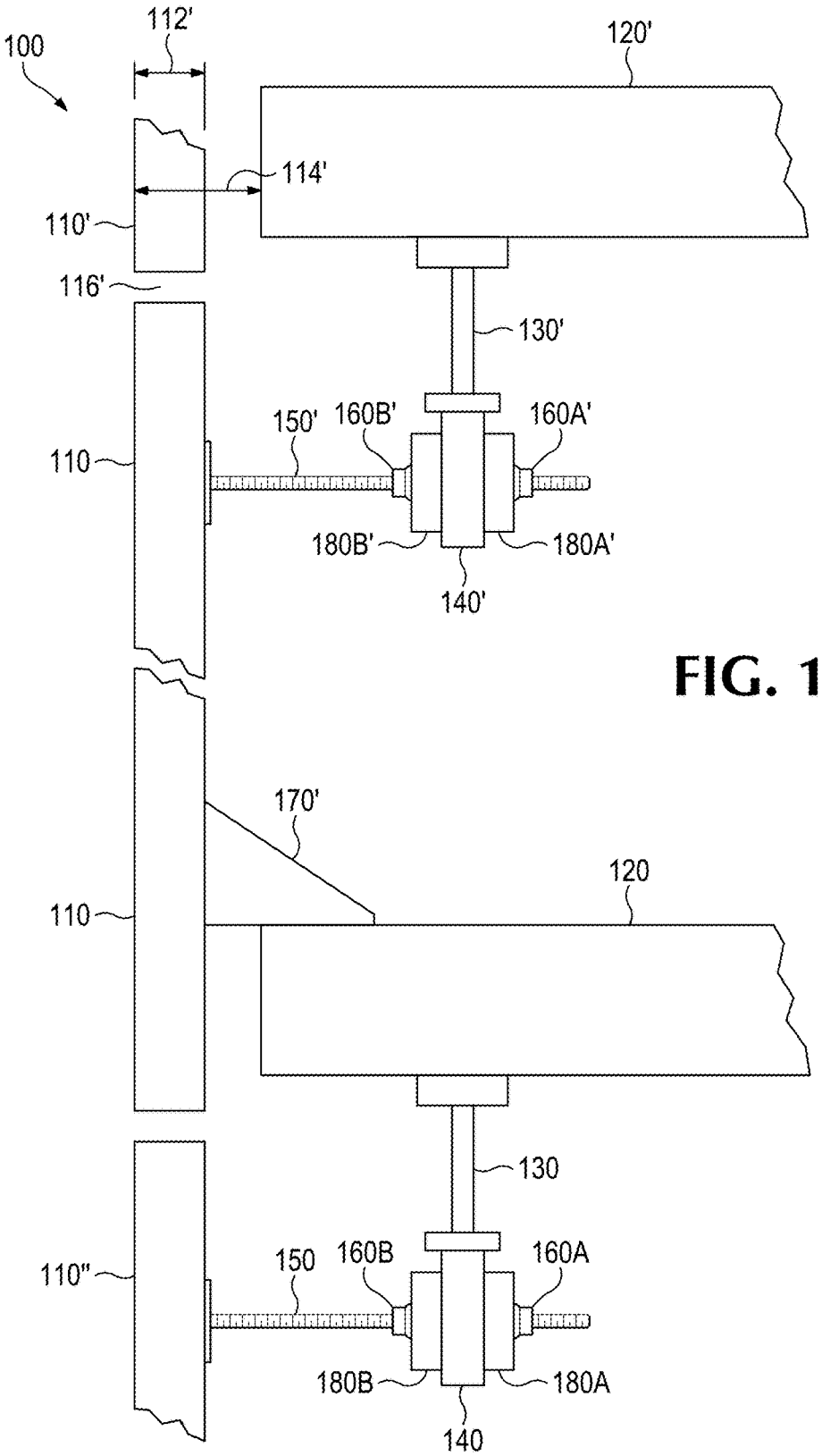
FIG. 1 is a side view assembly drawing.

| | |
|---|---|
| Pre-cast panel | 110 |
| Pre-cast panel width | 112 |
| Pre-cast panel distance from pre-cast panel to structure | 114 |
| Pre-cast panel to panel gap | 116 |
| Building floor | 120 |
| Perimeter Structural Beam | 130 |
| Bracket | 140 |
| Threaded Rod | 150 |
| Adjusting Nut | 160 |
| Bearing Connection | 170 |
| Crushing Tube | 180 |
| Coil Spring | 200 |

DETAILED DESCRIPTION

Referring to the figures wherein like reference numerals denote like structure throughout the specification the following representative embodiments are now described. The notation ‘ ” or characters A,B,C etc represent a repetition of the same element.

Now referring to FIG. 1 which illustrates a side view of a multistory building 100 with architectural pre-cast panel 110 mounted on the side of the building, typically mounted one per building floor 120. The architectural pre-cast panel 110 is connected to the perimeter structural beam 130 using a bracket 140 via a threaded rod 150. The threaded rod 150 is securely affixed to the architectural pre-cast panel 110. At the base of the architectural pre-cast panel 110 is a bearing connection 170 that supports the weight of the architectural pre-cast panel 110. The architectural pre-cast panel 110 is positioned relative to the building floor 120 by adjusting nuts 160A/160B that are threaded onto the threaded rod 150. Placed on the threaded rod 150 are crushing tubes 180A/180B. The adjusting nut 160A/160B are tightened against the crushing tubes 180A/180B.

Figure 2:
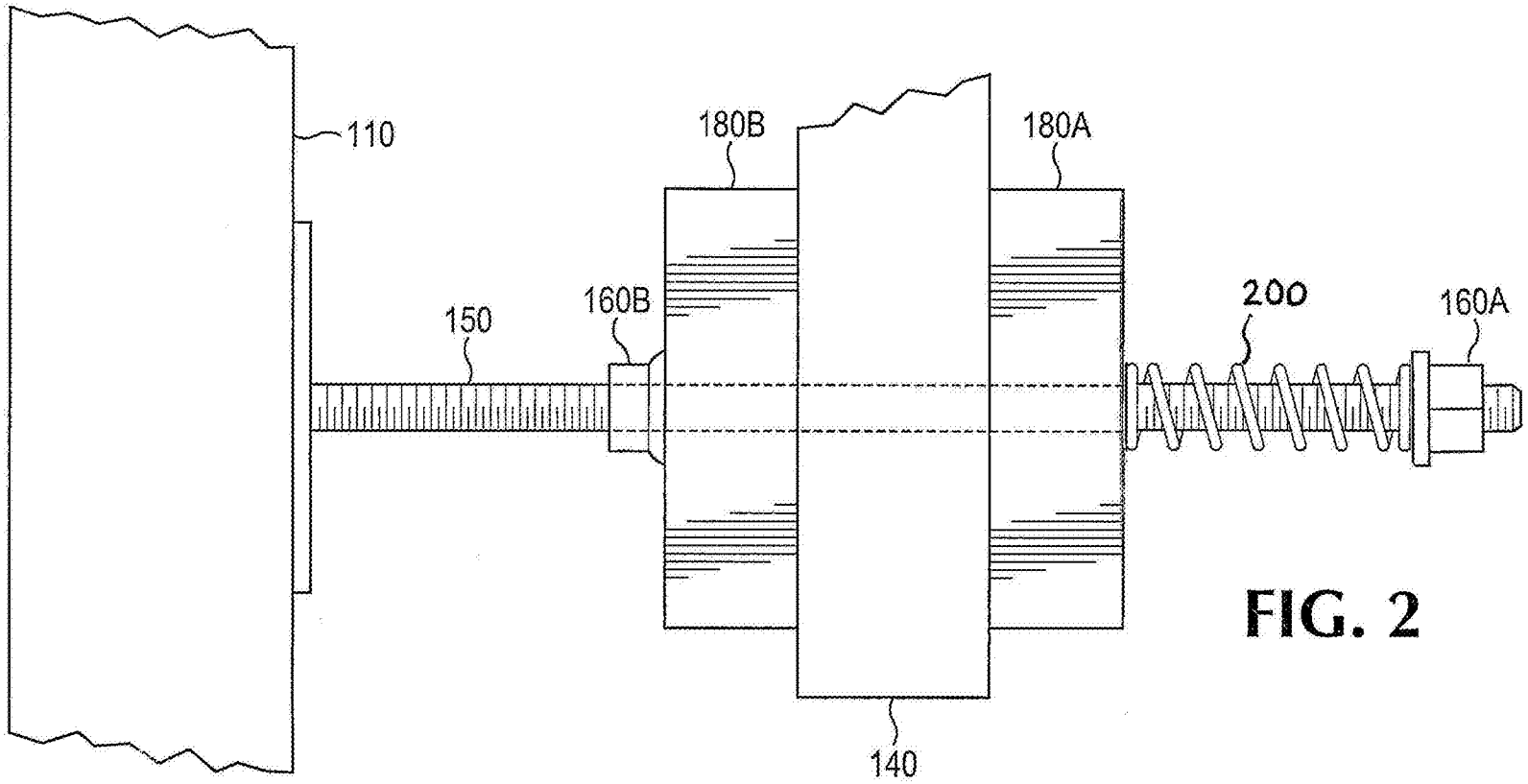
FIG. 2 is a close-up view of the components surrounding a crushing tube and a coil spring.

Now referring to FIG. 2 which shows a close-up view of the crushing tubes 180A/180B which are placed on the threaded rod 150 on either side of the bracket 140. The crushing tubes 180A/180B are tightened against the bracket 140 via the adjusting nut 160A/160B on either side of the crushing tubes 180A/180B. The coil spring 200 is placed on the rod 150 between the crushing tube 180 and the adjusting nut 160.

Figure 3:
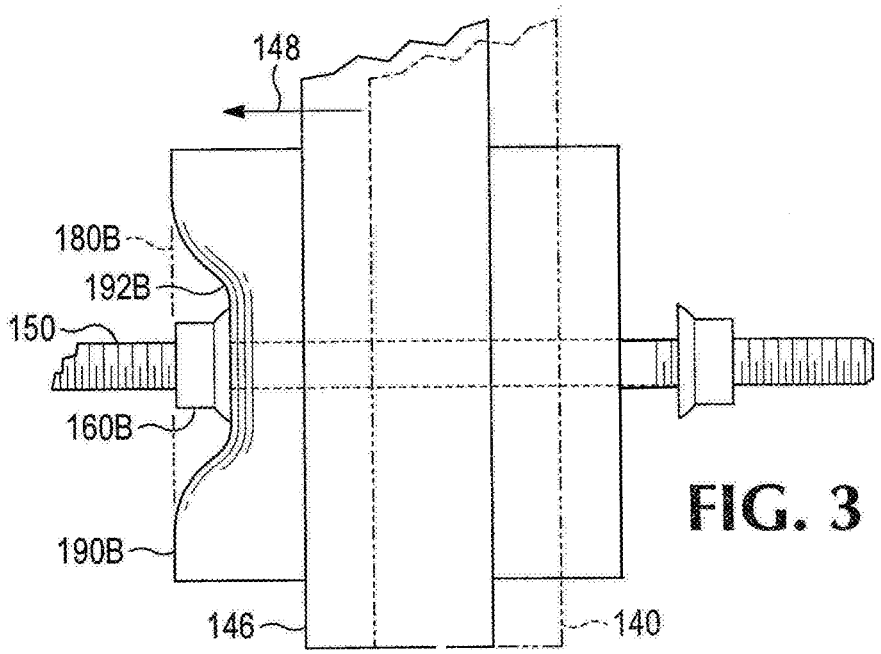
FIG. 3 is a close-up view of the effect on the crushing tube when relative force of the architectural panel exceeds a predetermined amount in an inward direction.

Now referring to FIG. 3 which shows an inward lateral movement 148 of the bracket 140 that is attached to the structural beam 130 relative to the pre-cast panel 110. The inward movement deforms 192B the crushing tube 180B and creates a deformed crushing tube 190B.

Figure 4A:
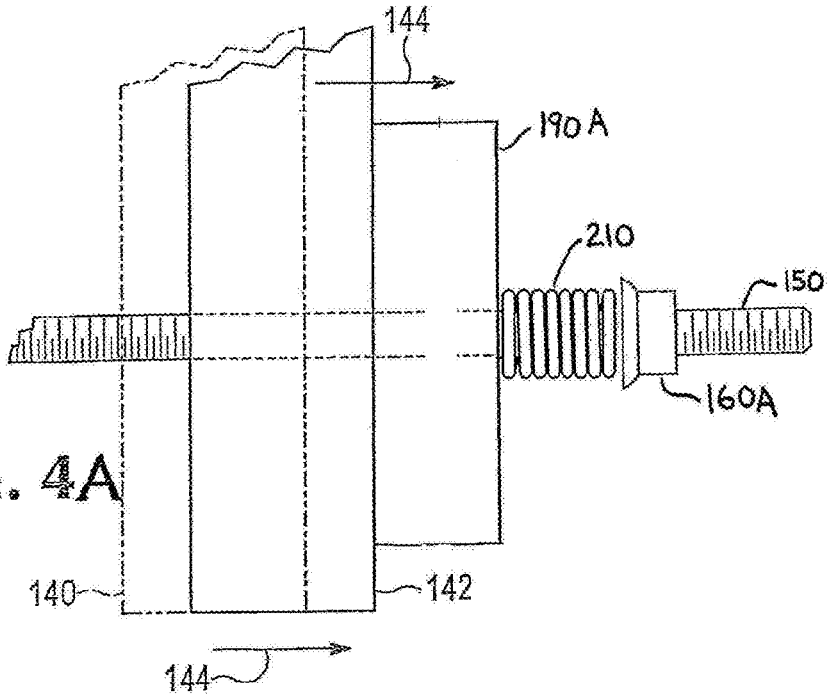
FIGS. 4A and 4B are each close-up views of the effect on the crushing tube when relative force of the architectural panel exceeds a predetermined amount in an outward direction.

Now referring to FIG. 1, FIG. 2 and FIG. 4A, whereby FIG. 4A shows an outward lateral movement 144 of the bracket 140 that is attached to the structural beam 130 relative to the precast panel 110. The outward movement compresses the coil spring 200 and creates a fully compressed spring 210.

Figure 4B:
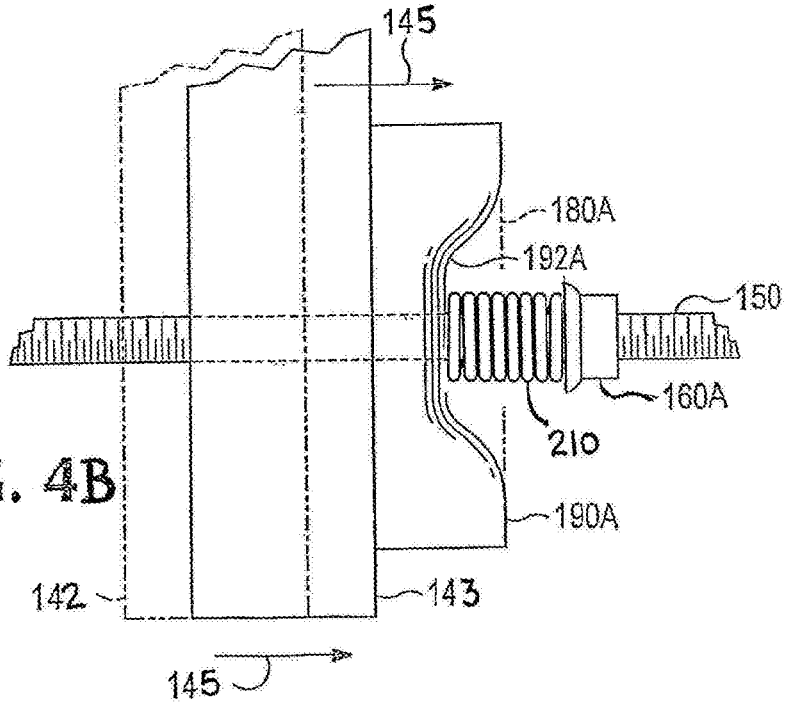

Now referring to FIG. 1, FIG. 2 and FIG. 4B, whereby FIG. 4B shows an additional outward lateral movement 145 of the bracket 142 that is attached to the structural beam 130 relative to the pre-cast panel 110. The additional outward movement deforms the crushing tube 180A and creates a deformed crushing tube 190A.

Figure 5:
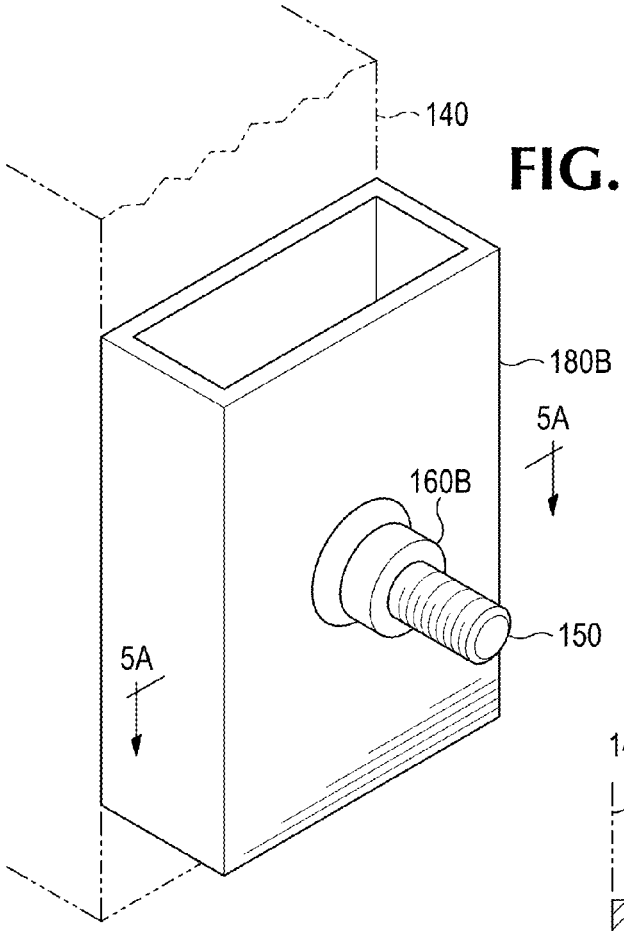
FIGS. 5 and 5A are each close-up views of the crushing tube.
Figure 5A:
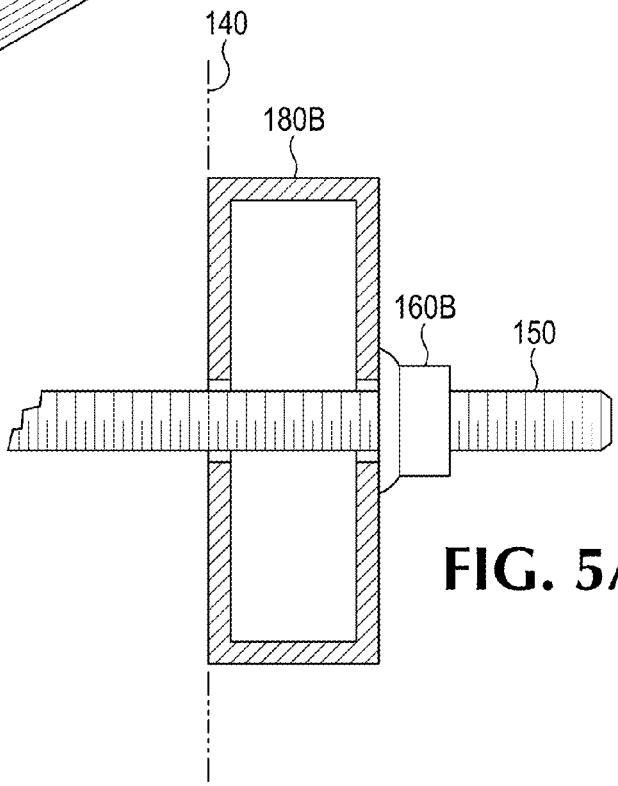

Now referring to FIG. 5 which shows a close-up view of the crushing tube 180A and a side view of the crushing tube 180B is as shown in FIG. 5A.

Figure 6:
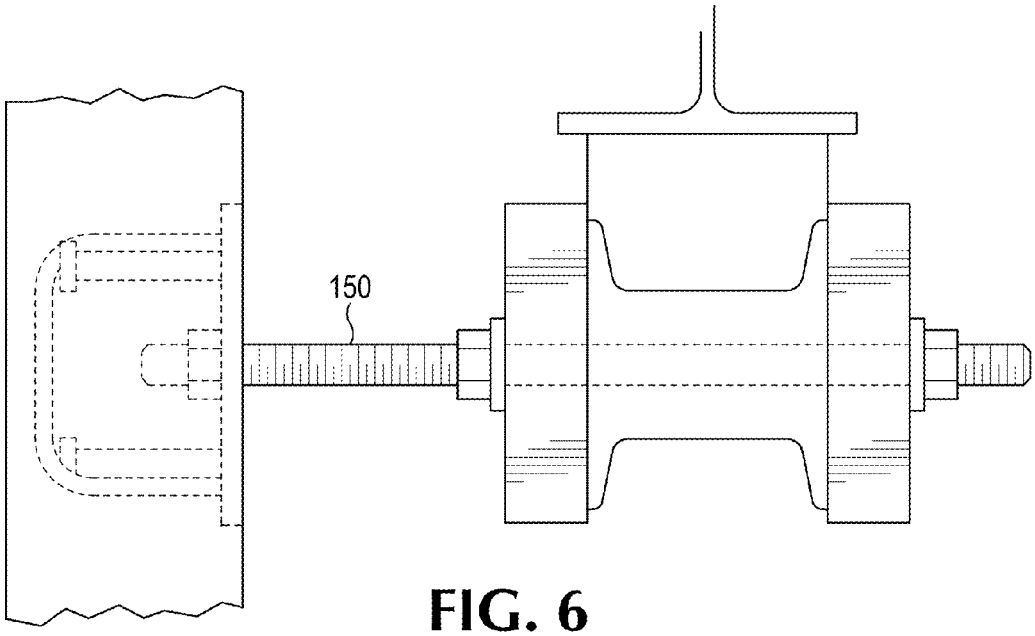
FIG. 6 is an installed view of the crushing tube.

Now referring to FIG. 6 which depicts a representative assembly having the threaded rod 150 that is approximately one inch in diameter with nuts that can thread on the rod. The crushing tube may have dimension of four or six or eight inches in height and two or three inches in width. It should appreciated by those of ordinary skill that the specific dimensional descriptions are exemplary only. Crushing tubes with other dimensions may be used that generally fall within the spirit and scope of the present inventive subject matter. The threaded rod 150 is typically connected to the architecture panel via an embedded U-shaped bar that has a welded plate to allow the passage of the threaded rod. Other means of securing the rod to the panel could be devised without changing the concept of the system.

Figure 7:
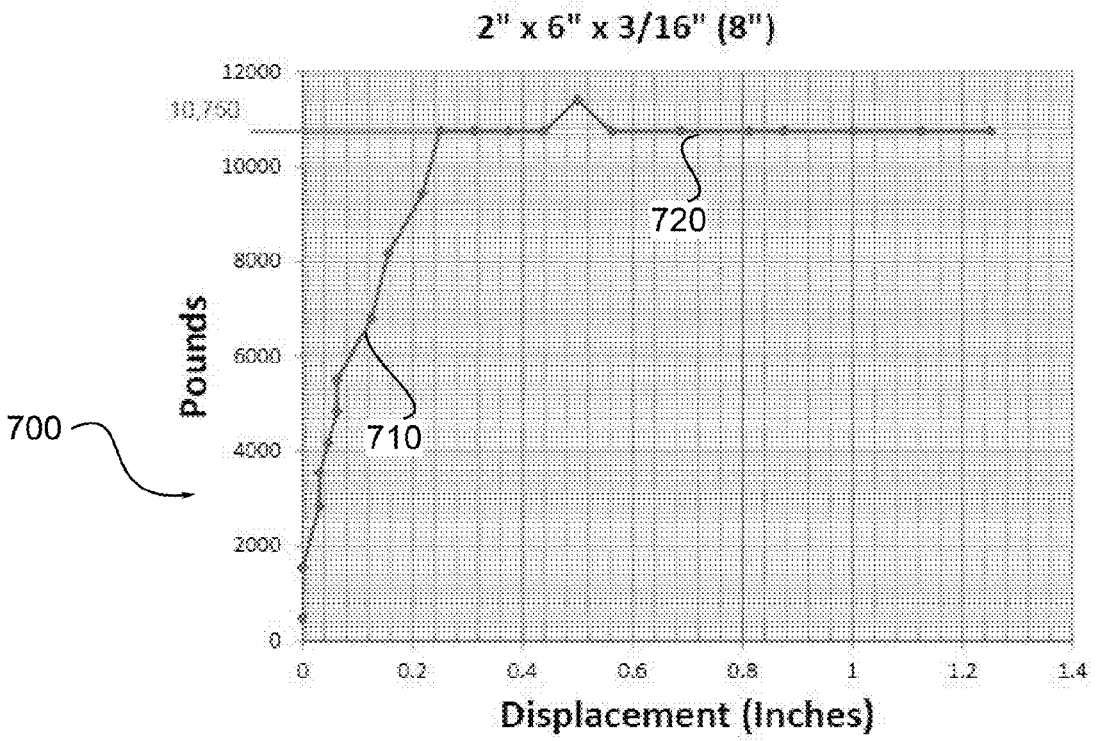
FIG. 7 is a graphical representation of variation of load with respect to displacement for an 8.0 inch crushing tube.
Figure 8:
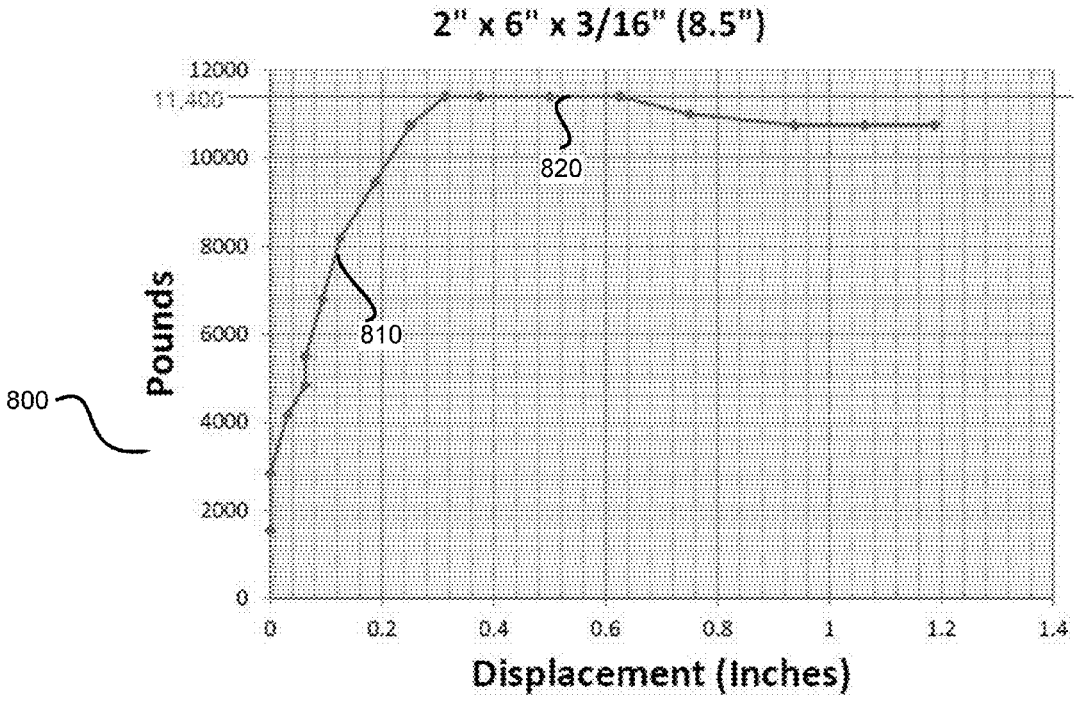
FIG. 8 is a graphical representation of variation of load with respect to displacement for an 8.5 inch crushing tube.
Figure 9:
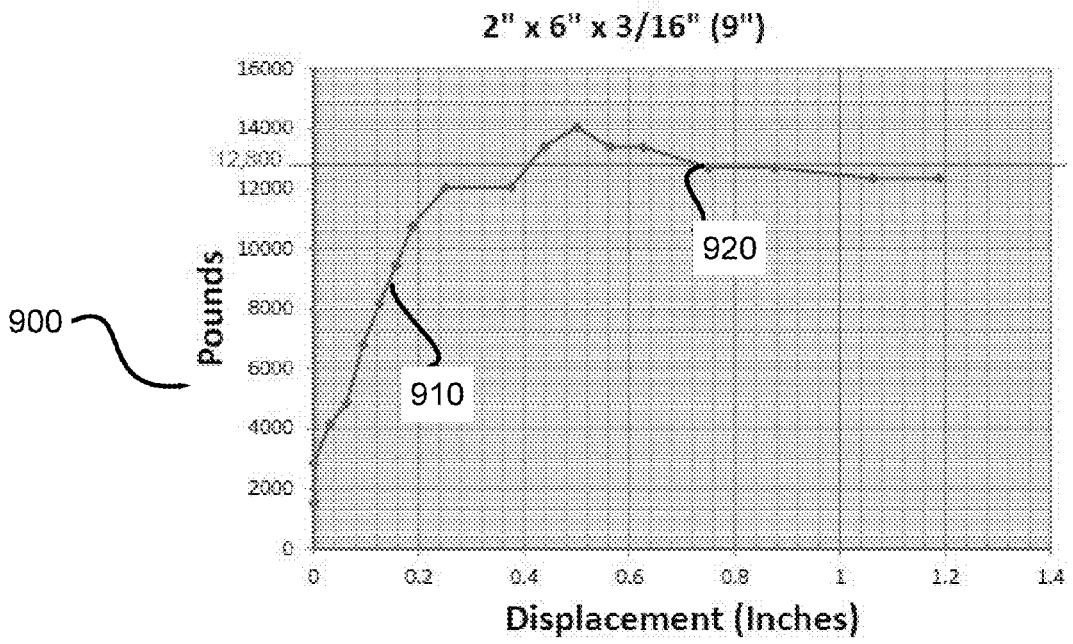
FIG. 9 is a graphical representation of variation of load with respect to displacement for a 9.0 inch crushing tube.

FIGS. 7, 8 and 9 are the graphical representation of the variation of yield load with respect to displacement for an 8.0 inch, 8.5 inch and 9.0 inch crushing tube respectively.

Table-1 given below shows variation of yield with load for an 8.0 inch crushing tube. FIG. 7 describes the graphical representation 700 for the same. Thus, for an 8.0 inch crushing tube the yield load increases with increasing displacement 710 and plateaus 720 at 10,750 pounds.

TABLE 1

| | 8 inches | | |
|---|---|---|---|
| S.N | Load | PSI | delta |
| 1 | 500 | 100 | 0 |
| 2 | 1550 | 500 | 0 |
| 3 | 2850 | 1000 | 1/32 |
| 4 | 3550 | 1250 | 1/32 |
| 5 | 4175 | 1500 | 3/64 |
| 6 | 4850 | 1750 | 1/16 |
| 7 | 5500 | 2000 | 1/16 |
| 8 | 6800 | 2500 | 1/8 |
| 9 | 8175 | 3000 | 5/32 |
| 10 | 9450 | 3500 | 7/32 |
| 11 | 10750 | 4000 | 1/4 |
| 12 | 10750 | 4000 | 5/16 |
| 13 | 10750 | 4000 | 3/8 |
| 14 | 10750 | 4000 | 7/16 |
| 15 | 11400 | 4250 | 1/2 |
| 16 | 10750 | 4000 | 9/16 |
| 17 | 10750 | 4000 | 11/16 |
| 18 | 10750 | 4000 | 13/16 |
| 19 | 10750 | 4000 | 7/8 |
| 20 | 10750 | 4000 | 1 |
| 21 | 10750 | 4000 | 1 1/8 |
| 22 | 10750 | 4000 | 1 1/4 |

Table-2 given below shows variation of yield with load for an 8.5 inch crushing tube. FIG. 8 describes the graphical representation 800 for the same. Thus, for an 8.5 inch crushing tube the yield load increases 810 with increasing displacement and plateaus 820 at 11,400 pounds.

TABLE 2

| | 8.5 inches | | |
|---|---|---|---|
| S.N | Load | PSI | delta |
| 1 | 1550 | 500 | 0 |
| 2 | 2850 | 1000 | 0 |
| 3 | 4175 | 1500 | 1/32 |
| 4 | 4850 | 1750 | 1/16 |
| 5 | 5500 | 2000 | 1/16 |
| 6 | 6800 | 25000 | 3/32 |
| 7 | 8175 | 3000 | 1/8 |
| 8 | 9450 | 3500 | 3/16 |
| 9 | 10750 | 4000 | 1/4 |
| 10 | 11400 | 4250 | 5/16 |
| 11 | 11400 | 4250 | 3/8 |
| 12 | 11400 | 4250 | 1/2 |
| 13 | 11400 | 4250 | 5/8 |
| 14 | 11400 | 4100 | 3/4 |
| 15 | 11000 | 4000 | 15/16 |
| 16 | 10750 | 4000 | 1 1/16 |
| 17 | 10750 | 4000 | 1 3/16 |

Table-3 given below shows variation of yield with load for a 9.0 inch crushing tube. FIG. 9 describes the graphical representation 900 for the same. Thus, for a 9.0 inch crushing tube the yield load increases with increasing displacement and plateaus 920 at 12,800 pounds.

TABLE 3

| | 9.0 inches | | |
|---|---|---|---|
| S.N | Load | PSI | delta |
| 1 | 1550 | 500 | 0 |
| 2 | 2850 | 1000 | 0 |
| 3 | 4175 | 1500 | 1/32 |
| 4 | 4850 | 1750 | 1/16 |
| 5 | 4850 | 2000 | 1/16 |
| 6 | 6800 | 2500 | 3/32 |
| 7 | 8175 | 3000 | 1/8 |
| 8 | 9450 | 3500 | 3/16 |
| 9 | 10750 | 4000 | 1/4 |
| 10 | 12050 | 4500 | 5/16 |
| 11 | 12050 | 4500 | 3/8 |
| 12 | 13400 | 5000 | 1/2 |
| 13 | 14041 | 5250 | 5/8 |
| 14 | 13400 | 5000 | 3/4 |
| 15 | 13400 | 5000 | 15/16 |
| 16 | 12700 | 4750 | 1 1/16 |
| 17 | 12700 | 4750 | 1 3/16 |

The moment carrying capacity of a steel member Mp also called the plastic moment for the section of the tube wall can be calculated by the formula: $M_P$=Fy (Yield Stress) *z (Plastic section modulus); $M_P$=57,290*b*0.188$^2$/4; $M_P$=506*b: Where b=Tube Length.

Further the yield load "P" on the whole tube can be calculated by the formula:

$$P*0.62=4M_P(1/2.625), \text{ thus } P=2.46M_P$$

By assuming a 10% over strength factor, P=1245.3*1.1*b=1370*b

For b (Tube Length)=4 inches: P=5480 Pounds

For b (Tube Length)=12 inches: P=16440 Pounds

Figure 10:
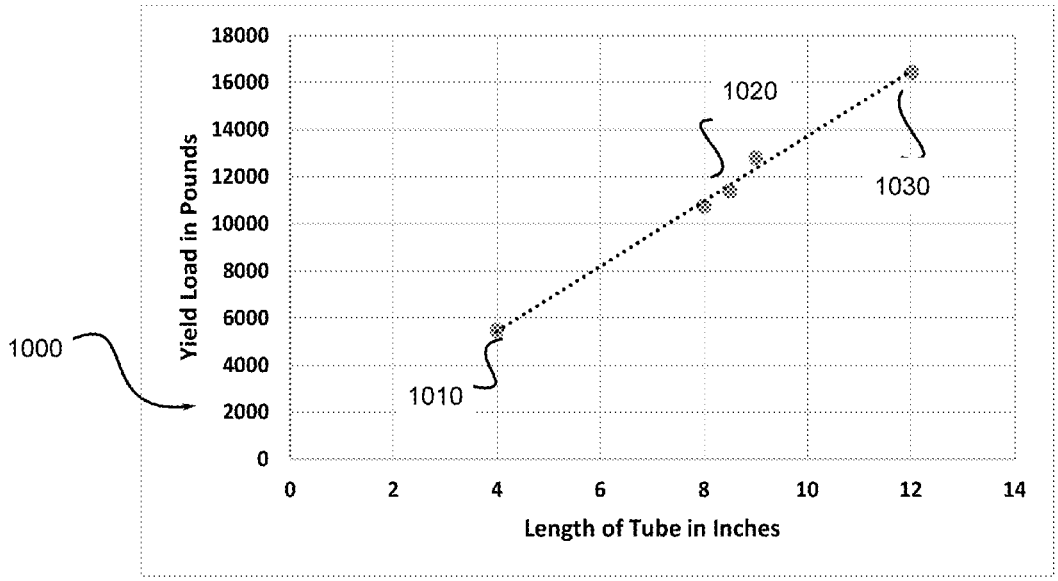
FIG. 10 is a graphical representation of the cumulative results of experimental results and theoretical predictions.

FIG. 10 represents the graphical representation 1000 of the cumulative results based on the experimental findings and the theoretical predictions. Length of the tube (in inches) is plotted on the horizontal axis and the yield load (in pounds) is plotted on the vertical axis. 1010 and 1030 represent the two end points determined by theoretical calculations described above. The three central points 1020 are determined by experimental results described in FIGS. 7, 8 and 9. The linear equation for the line drawn through the experimental and theoretical results can be generally represented by $y=1380.5x-83.796$ with $R^2=0.9949$. The conclusion drawn by these efforts is that the yield load is linearly proportional to tube length. This allows for designing the crushing tube to conform to the specific requirements of each application.

Referring to Table-4 which represents the mill certificate showing the results for manufactured product—ASTM A500 GR B-2010, wherein "T" represents the thickness of the crushing tube as manufactured. All the material products were tested for variation in size, mechanical and chemical properties under various thermal conditions. A 0.188 inch thickness crushing tube was used as the base sample for comparison purposes. The mill certificate certifies the products to be of the desired good quality and indicates the yield strength of the specific material used for the crushing tube.

TABLE 4

| S.N | Heat No. | T | L | Tensile (psi) | Y.P (psi) |
|---|---|---|---|---|---|
| 1. | 472005537 | 0.188 | 40 | 65,702 | 46,977 |
| 2. | 473005414 | 0.250 | 20 | 67,008 | 47,853 |
| 3. | 473005419 | 0.250 | 40 | 65,267 | 46,290 |
| 4. | 473002067 | 0.188 | 20 | 70,199 | 57,290 |
| 5. | 473002067 | 0.188 | 40 | 70,199 | 57,290 |
| 6. | 473005414 | 0.250 | 20 | 67,008 | 47,863 |

Persons skilled in the art will recognize that many modifications and variations are possible in the details, materials, and arrangements of the parts and actions which have been described and illustrated in order to explain the nature of this inventive concept and that such modifications and variations do not depart from the spirit and scope of the teachings and claims contained therein.

All patent and non-patent literature cited herein is hereby incorporated by references in its entirety for all purposes.

What is claimed is:

1. A system for protecting the interior of a building, the system comprising:

a precast panel mounted on to a structure of the building;

a bracket connected to a structural beam of the building, the bracket capable of bracing the precast panel with a threaded rod;

a first crushing tube and a second crushing tube, each of the first and second crushing tubes placed on either side of the bracket on the threaded rod.

2. The system as set forth in claim 1, wherein a first crushing tube is placed on a first side of the bracket and a second crushing tube is place on a second side of the bracket.

3. The system as set forth in claim 2, wherein the first and second crushing tubes are each tightened against the bracket by using an adjusting nut for each of the first and second crushing tubes.

4. The system as set forth in claim 1, wherein the threaded rod is connected to the precast panel via an embedded U-shaped bar that has a welded plate to allow the passage of the threaded rod.

5. The system as set forth in claim 1, wherein the first and second crushing tubes each have a width ranging between 3.8 inches to 8.2 inches, a depth ranging between 1.8 inches to 4.2 inches and a length ranging between 3.8 inches to 12.2 inches.

6. The system as set forth in claim 1, wherein the threaded rod has a diameter ranging between 0.6 inches to 1.3 inches.

7. An impact absorbing apparatus, comprising:

an architectural precast panel capable of being mounted to a structure;

a threaded rod capable of being secured to the architectural precast panel on one end and a to a structural beam within the interior of the structure on another end;

a first crushing tube and a second crushing tube together, capable of bracketing the structural beam on each of a first side and a second side of the structural beam.

8. The apparatus as set forth in claim 7, further comprising:

a bearing capable of supporting the weight of the architectural precast panel to the structure.

9. The apparatus as set forth in claim 7, wherein the structure comprises a multistory building.

10. The apparatus as set forth in claim 7, wherein the structure comprises a one-story building.

11. The apparatus as set forth in claim 7, wherein the impact comprises at least one of a seismic event, an explosion blast, and wind shear.

* * * * *